United States Patent [19]

Nine

[11] Patent Number: 5,014,537

[45] Date of Patent: May 14, 1991

[54] CONVERTIBLE LOCKBEAD-DRAWBEAD

[75] Inventor: Harmon D. Nine, Fraser, Mich.

[73] Assignee: General Motors Corporation, Detroit, Mich.

[21] Appl. No.: 538,052

[22] Filed: Jun. 13, 1990

[51] Int. Cl.[5] ..... B21D 24/04

[52] U.S. Cl. ..... 72/350; 72/297

[58] Field of Search ..... 72/296, 297, 313, 350, 72/351

[56] References Cited

U.S. PATENT DOCUMENTS

| | | | |
|---|---|---|---|
| 3,299,689 | 1/1967 | Dolney et al. | 72/350 |
| 4,195,510 | 4/1980 | Juergens | 72/350 |
| 4,550,585 | 11/1985 | Sasaki | 72/351 |

*Primary Examiner*—Lowell A. Larson

*Attorney, Agent, or Firm*—Herbert Furman

[57] ABSTRACT

A bead structure for die binders which is easily convertible into either a drawbead structure or a lockbead structure includes a bead on one die binder having a generally planar roughened outer wall, a groove in the other binder, and a bead insert which is removably secured in the groove and includes a base of semi-rigid material and a series of segments secured to the base and having roughened outer walls juxtaposed to the roughened outer wall of the bead and providing a lockbead structure therewith when the binders close against a sheet metal blank. When the bead insert is removed, the bead and groove provide a drawbead structure. The sheet metal blank slides through the groove and over the roughened outer wall of the bead since the shoulders of the bead have a radius less than the radius of bending of the blank as it passes over the bead.

4 Claims, 1 Drawing Sheet

CONVERTIBLE LOCKBEAD-DRAWBEAD

This invention relates to a bead structure and more particularly to a bead structure which is easily and quickly convertible into either a drawbead or a lockbead structure.

BACKGROUND OF THE INVENTION

Drawbead structures are used to control the flow of a sheet metal blank within a drawing die during drawing operations. Generally such structures include a bead or male drawbead structure on the binder face of one die and a groove or female drawbead structure in the binder face of the other die. The drawbead structures interfit in spaced relationship to each other when the die is closed. The drawbead structure resists pulling of the edge portion of the sheet metal blank into the die through a combination of deformation forces and friction forces resulting from the edge portion of the blank being alternately bent and straightened as it passes around the bead and through the groove into the die.

Lockbead structures are used to prevent the flow of the sheet metal blank within a die during stretch forming operations. Generally such structures include a bead or male lockbead structure on the binder face of one die and a groove or female lockbead structure in the binder face of the other die. The lockbead structures interfit in closely spaced relationship to each other when the die is closed to clamp the sheet metal blank therebetween and prevent the edge portion of the blank from being pulled into the die.

Drawbead structures and lockbead structures are conventionally built on and into the dies, and during die tryout, the restraining force is set by adding or grinding off material from the bead and groove in a trial and error process.

It is often difficult, if not impossible, to determine in advance whether a die formed part can be successfully stretch formed or whether it must be drawn. If the die is designed with a lockbead structure and the part cannot be stretch formed without splitting, the bead and the groove must then be barbered or ground in a trial and error process to alter the lockbead structure into a drawbead structure. Such a process can be time consuming and often result in a poor drawbead structure if too much material is removed from the bead or groove. Likewise, if the die is designed with a drawbead structure and it is decided that it may be advantageous to form the part by a stretch forming operation, material must be added to the bead and/or the groove and some grinding must be done on a trial and error basis to convert the drawbead structure into a lockbead structure.

SUMMARY OF THE INVENTION

The bead structure of this invention is easily convertible into either a drawbead structure or a lockbead structure.

In its preferred embodiment, the bead structure includes a bead or male bead structure on the binder face of one die which has a generally planar outer wall joined to the side walls of the bead by arcuate juncture shoulders. The outer wall is provided with a roughened or irregular surface intermediate the juncture shoulders. The bead structure further includes a groove or female bead structure in the binder face of the other die. The groove removably receives a bead insert having a base of urethane or similar semi-rigid material which seats on the base wall of the groove and is removably secured within the groove by being slightly wedged between the side walls thereof. A series of slightly spaced metal blocks or segments are removably secured to the base to provide a bead. Each segment has an outer wall matching the outer wall of the male bead structure and provided with a roughened or irregular surface. The bead of the insert can also be formed of other types of segments, such as the wafers or pleated members, shown in U.S. Pat. No. 4,531,395, Nine et al, Modular Drawbead Structure. When the bead structure is used as a lockbead structure, the outer walls of the male bead structure and the bead insert tightly clamp the edge portion of the sheet metal blank therebetween and prevent the flow of the blank into the die during stretch forming operations. When the bead structure is used as a drawbead structure, the bead insert is removed and the sheet metal blank moves through the groove and over the arcuate juncture shoulders of the male bead structure in spaced relationship to the roughened outer wall thereof since the radius of bending of the sheet metal blank is greater than that of the arcuate juncture shoulders. Thus, the bead structure of this invention permits the sheet metal part to be designed to be formed by one type of forming, either stretch or draw, and, if this type of forming is unsuccessful, the part can then be formed by the other type of forming without extensive and time consuming alteration of the die.

The primary feature of this invention is that it provides a bead structure which is convertible into either a drawbead structure or a lockbead structure. Another feature is that the bead structure includes a male bead structure having an outer wall provided with a roughened surface intermediate arcuate juncture shoulders joining the outer wall to side walls, and a groove or female bead structure removably receiving a bead insert provided with an outer wall matching that of the male bead structure and cooperative therewith to clamp a sheet metal blank therebetween during stretch forming operations. A further feature is that the bead insert includes a base of semi-rigid material and a bead of metal segments removably secured thereto. Yet another feature is that the bead insert is removably retained within the groove by having the base thereof slightly wedged between the side walls of the groove. Yet a further feature is that the segments have outer walls conforming to the shape of the outer wall of the male bead structure and provided with roughened surfaces.

These and other features of the invention will be readily apparent from the following specification and drawings wherein.

Figure 1:
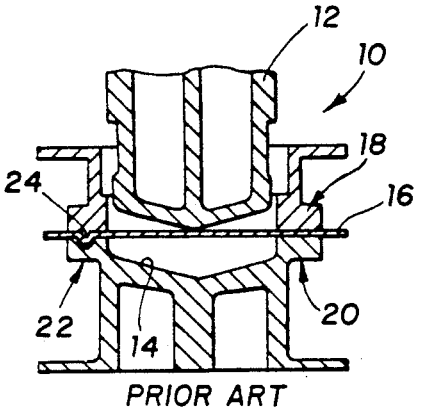
FIG. 1 is a schematic view of a press and conventional drawbead structure.
Figure 2:
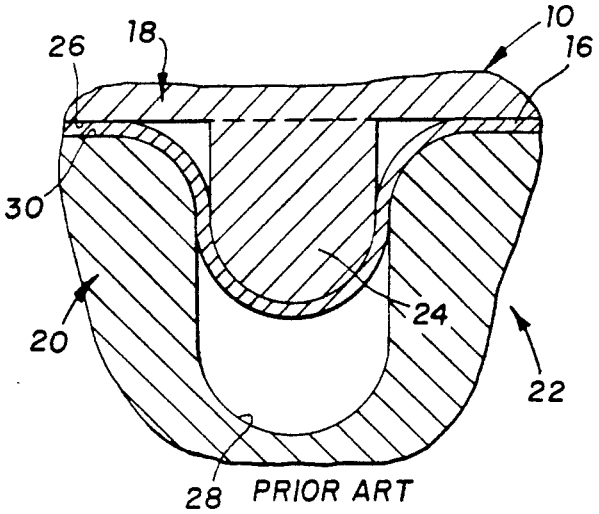
FIG. 2 is an enlarged view of a portion of FIG. 1 showing the drawbead structure.
Figure 3:
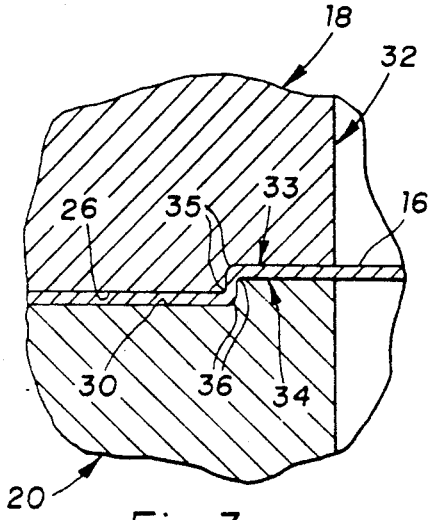
FIG. 3 is a view similar to FIG. 2 showing a lockbead structure.

Referring now to FIGS. 1, 2 and 3 of the drawings, a conventional stamping press 10 is schematically indicated as including a punch 12 which moves inwardly and outwardly with respect to a die cavity 14 to form a stamped part from a blank 16 of sheet metal. The blank 16 extends across the die cavity. If the part is formed by drawing, the edge portion of blank 16 is restricted against movement into the die cavity when engaged by punch 12 by upper and lower die binders 18 and 20 which releasably grip the edge portion of the blank through a drawbead structure 22 shown in enlarged detail in FIG. 2. The drawbead structure 22 includes a bead or male drawbead structure 24 which projects downwardly from the face 26 of the upper die binder 18 and a groove or female drawbead structure 28 which projects inwardly from the face 30 of the lower die binder 20. If the part is formed by stretch forming the edge portion of the blank is held against any movement into the die cavity when engaged by punch 12 through a lockbead structure 32 shown in detail in FIG. 3. The lockbead structure includes a stepped lockbead structure 33 on the face 26 of the upper die binder 18 and a mating stepped lockbead structure 34 on the face 30 of the lower die binder 20. The sharp inner and outer corners 35 of the structure 33 and mating outer and inner corners 36 of the structure 34 provide the lockbead when the binders 18 and 20 are closed to each other. If the part is to be formed by stretch forming, the die binders 18 and 20 are provided with the lockbead structure 32. During die tryout, if splitting or cracking of the part occurs, then the lockbead structure must be converted to a drawbead structure through removal of material from the bead 34 and from the groove 36 to shorten and narrow the former and widen the latter. This is time consuming and expensive and must be done through a trial and error process. Likewise if the die is designed to form the part by drawing, and it is desired to determine if the part can be formed by stretch forming, material must be added to the bead 34 to widen and extend the bead. This again is a time consuming and expensive trial and error process.

Figure 4:
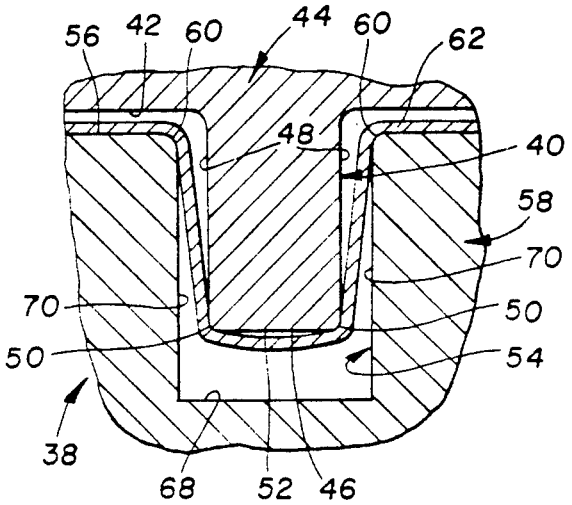
FIG. 4 is a view of the bead structure of this invention when used as a drawbead structure.

Referring now to FIG. 4 of the drawing, a bead structure 38 according to this invention includes a bead or male bead structure 40 projecting from the face 42 of an upper die binder 44. The bead structure 40 includes an outer wall 46 joined to side walls 48 across arcuate juncture shoulders 50 of predetermined radius, such as 0.125 inch. The surface of the wall 46 is roughened at 52, such as by scarifying, coating with tungsten carbide, or otherwise. The roughened surface 52 stops short of the tangency between wall 46 and shoulders 50.

The bead structure 38 further includes a groove or female bead structure 54 which projects inwardly from the face 56 of a lower die binder 58 and is joined to the face 56 across arcuate juncture shoulders 60 of predetermined radius, such as 0.125 inch.

During the drawing operation, as shown in FIG. 4, the edge portion of the sheet metal blank 62 moves through the groove 54 and around the bead structure 40 to alternately bend and straighten and provide a predetermined resistance to movement of the blank within the die cavity, not shown. The sheet metal blank moves over the outer wall 46 in spaced relationship to the roughened surface 52 since the radius of the shoulders 50 is less than the radius of bending of the sheet metal blank, as shown. The only contact between the sheet metal blank 62 and the bead structure 38 is at the arcuate juncture shoulders 50 and 60 of the bead 40 and groove 54, respectively.

Figure 5:
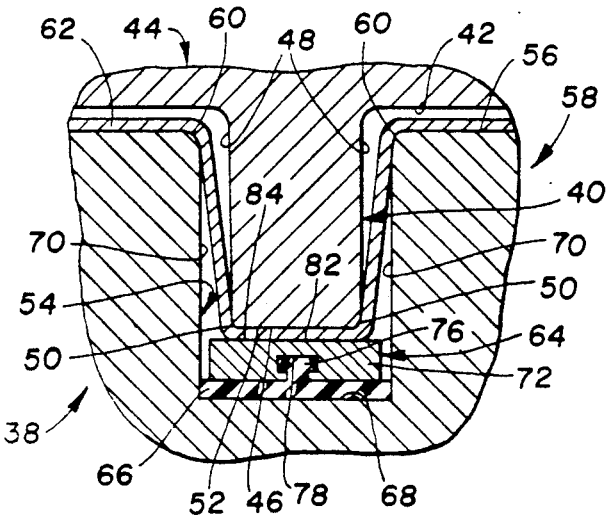
FIG. 5 is a view of the bead structure of this invention when used as a lockbead structure.
Figure 6:
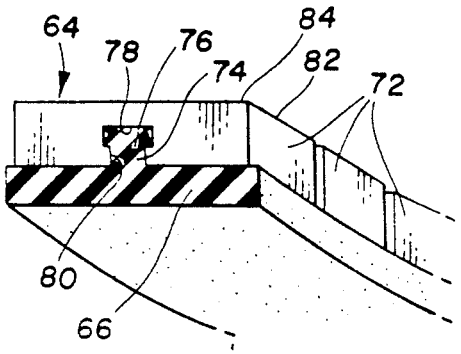
FIG. 6 is a perspective view of a portion of FIG. 5.

Referring now to FIGS. 5 and 6, the bead structure 38 is convertible into a lockbead structure by inserting a bead insert 64 into the groove 54. The bead insert includes a base 66 of semi-rigid material, such as urethane, which seats on the base wall 68 of the groove 54 and extends between the side walls 70 of the groove so as to be slightly wedged therebetween and located relative to the groove during forming operations. The base 66 need not be adhesively or otherwise secured to the wall 68 so as to be readily removable. As shown in FIG. 6, the base 66 is also laterally flexible so as to follow the contours or sinuosity of the groove 54. It should also be mentioned that the base 66 can be segmented if desired and need not be continuous. A series of metal segments 72 are removably secured to the base 66. The base is provided with a continuous upwardly extending integral rib 74 having a truncated head 76 which is received within a lateral re-entrant groove 78 through each metal segment 72. The groove 78 opens outwardly through a slot 80 receiving the rib 74 of the base 66. Although the rib 74 and head 76 are shown as continuous, so as to be formed integral with the base by extrusion, they can also be segmented if so desired. However, by forming the rib and head integral with the base, the metal segments 72 can be located and spaced from each other as desired or as dictated by the contour or sinuosity of the groove 54. Although the metal segments 72 are shown as having the same length, this is not a necessary requirement. Further, the metal segments can be of a lesser width than the base 66, as long as the width of the segments is slightly greater than that of the outer wall 46 of the bead structure 40, as shown. The outer wall 82 of each of the segments 72 is provided with a roughened surface 84 which can be provided in the same manner as the roughened surface 52 of the outer wall 46 of the bead structure 40.

During stretch forming operations, as shown in FIG. 5, the edge portion of the sheet metal blank 62 is forced to conform to the shape of the bead 40 and groove 54 and is tightly clamped between the roughened surfaces 84 and 52 of the segments 72 and bead 40, respectively to prevent movement of the edge portion of the blank into the forming die, not shown.

If, during die tryout of a stretch forming operation, the sheet metal blank 62 cracks or splits, the operator can quickly and easily remove the bead insert 64 and manufacture the part by a drawing operation. Likewise, if the part is being made by a drawing operation and it is desired to determine if the part can be made by a stretch forming operation, the operator can quickly and easily insert the bead insert 64 into the groove 54 and determine if stretch forming is possible.

Thus, this invention provides a bead structure which is quickly and easily convertible into a drawbead structure or a lockbead structure.

The embodiments of the invention in which an exclusive property or privilege is claimed are defined as follows:

1. A bead structure for a pair of die binders having binder faces which close relative to each other and to a blank during press operation comprising, in combination, an outwardly opening groove in one die binder having a base wall and side walls, the side walls being joined to the face of the one binder across arcuate shoulders, a bead projecting from the face of the other die binder and received within the groove, the bead including side walls spaced from the side walls of the groove and an outer wall joined to the bead side walls across arcuate shoulders, the bead outer wall being generally planar intermediate the arcuate bead shoulders, means roughening the outer wall of the bead intermediate the bead arcuate shoulders, a bead insert removably mounted in the groove and including a generally planar outer wall juxtaposed to the outer wall of the bead, the roughened outer wall of the bead and the outer wall of the bead insert clamping the blank therebetween to provide a lockbead during press operation, removal of the insert permitting the blank to slide over the shoulders of the groove, between the side walls of the groove and of the bead, and over the shoulders of the bead in spaced relationship to the roughened means on the outer wall of the bead to provide a drawbead during press operation.

2. A bead structure for a pair of die binders having binder faces which close relative to each other and to a blank during press operation comprising, in combination, an outwardly opening groove in one die binder having a base wall and side walls, the side walls being joined to the face of the one binder across arcuate shoulders, a bead projecting from the face of the other die binder and received within the groove, the bead including side walls spaced from the side walls of the groove and a bead outer wall joined to the bead side walls across arcuate shoulders, the bead outer wall being generally planar intermediate the arcuate bead shoulders, a bead insert removably mounted in the groove and including a base and a series of segments mounted to the base, the segments having generally planar outer walls juxtaposed to the outer wall of the bead, means roughening the outer wall of the bead intermediate the bead arcuate shoulders, the roughening means on the outer wall of the bead and the outer walls of the segments of the bead insert clamping the blank therebetween to provide a lockbead during press operation, removal of the bead insert permitting the blank to slide over the shoulders of the groove, between the side walls of the groove and of the bead, and over the shoulders of the bead in spaced relationship to the roughened means on the outer wall of the bead to provide a drawbead during press operation.

3. A bead structure for a pair of die binders having binder faces which close relative to each other and to a blank during press operation comprising, in combination, an outwardly opening groove in one die binder having a base wall and side walls, the side walls being joined to the face of the one binder across arcuate shoulders, a bead projecting from the face of the other die binder and received within the groove, the bead including side walls spaced from the side walls of the groove and an outer wall joined to the bead side walls across arcuate shoulders, the outer wall of the bead being generally planar intermediate the arcuate bead shoulders, a bead insert removably mounted in the groove and including a base of semi-rigid material wedged between the side walls of the groove and a series of segments mounted to the base and having outer walls juxtaposed to the outer wall of the bead, means roughening the outer wall of the bead intermediate the bead arcuate shoulders, the roughening means on the outer wall of the bead and the outer walls of the segments clamping the blank therebetween to provide a lockbead during press operation, removal of the bead insert permitting the blank to slide over the shoulders of the groove, between the side walls of the groove and of the bead, and over the shoulders of the bead in spaced relationship to the roughened outer wall of the bead to provide a drawbead during press operation.

4. A bead structure for a pair of die binders having binder faces which close relative to each other and to a blank during press operation comprising, in combination, an outwardly opening groove in one die binder having a base wall and side walls, the side walls being joined to the face of the one binder across arcuate shoulders, a bead projecting from the face of the other die binder and received within the groove, the bead including side walls spaced from the side walls of the groove and an outer wall joined to the bead side walls across arcuate shoulders, the bead outer wall being generally planar intermediate the arcuate bead shoulders, means roughening the outer wall of the bead intermediate and spaced from the bead arcuate shoulders, a bead insert removably mounted in the groove and including a base of semi-rigid material releasably secured to the walls of the groove and having a series of bead segments secured thereto and provided with outer walls having roughened surfaces juxtaposed to the outer wall of the bead, the roughened outer walls of the bead and of the segments clamping the blank therebetween to provide a lockbead during press operation, removal of the bead insert permitting the blank to slide over the shoulders of the groove, between the side walls of the groove and of the bead, and over the shoulders of the bead in spaced relationship to the roughened outer wall thereof to provide a drawbead during press operation.

* * * * *